United States Patent [19]

Saito et al.

[11] Patent Number: 4,911,227

[45] Date of Patent: Mar. 27, 1990

[54] HEAT EXCHANGE APPARATUS FOR EFFECTING HEAT EXCHANGE IN PLURALITY OF GASES, HEAT EXCHANGE ELEMENT FOR USE IN SAID APPARATUS AND PROCESS FOR PREPARATION OF SAID HEAT EXCHANGE ELEMENT

[75] Inventors: Naohide Saito, Niigata; Junichi Tamura; Shigeo Take, both of Kanagawa; Masaji Kurosawa, Chiba; Isao Terada, Kanagawa, all of Japan

[73] Assignee: Nippon Oil Co., Ltd., Tokyo, Japan

[21] Appl. No.: 195,674

[22] Filed: May 13, 1988

[30] Foreign Application Priority Data

May 15, 1987 [JP] Japan ..... 62-116793

[51] Int. Cl.[4] ..... F28F 21/00

[52] U.S. Cl. ..... 165/10; 165/54; 165/166; 165/905; 165/133

[58] Field of Search ..... 165/54, 10, 166, 905, 165/133

[56] References Cited

U.S. PATENT DOCUMENTS

| | | | |
|---|---|---|---|
| 4,200,441 | 4/1980 | Honmann et al. | 165/10 |
| 4,377,400 | 3/1983 | Okamoto et al. | 165/54 |

FOREIGN PATENT DOCUMENTS

| | | | |
|---|---|---|---|
| 127663 | 10/1977 | Japan . | |
| 19548 | 2/1979 | Japan . | |
| 11397 | 1/1983 | Japan | 165/905 |
| 50398 | 3/1985 | Japan | 165/905 |
| 62598 | 4/1985 | Japan | 165/905 |

*Primary Examiner*—Albert W. Davis, Jr.
*Attorney, Agent, or Firm*—Lowe, Price, LeBland, Becker & Shur

[57] ABSTRACT

Disclosed are a heat exchange element obtained by forming a sheet material or honeycomb structure having a shape required for a heat exchange element from an organic filler-filled sheet made from an acid-resistant glass fiber, dipping the formed sheet material or honeycomb structure in a suspension of an inorganic filler, at least a part of which is composed of scaly particles, and fixing the inorganic filler applied by the dipping treatment to the sheet material or honeycomb structure by a binder, and a process for the preparation of this heat exchange element and a heat exchange apparatus comprising this heat exchange element. A high acid resistance and a high gas-intercepting property can be maintained even by using a thin and light sheet material.

16 Claims, 2 Drawing Sheets

HEAT EXCHANGE APPARATUS FOR EFFECTING HEAT EXCHANGE IN PLURALITY OF GASES, HEAT EXCHANGE ELEMENT FOR USE IN SAID APPARATUS AND PROCESS FOR PREPARATION OF SAID HEAT EXCHANGE ELEMENT

BACKGROUND OF THE INVENTION (1) Field of the Invention

The present invention relates to a gas heat exchange apparatus for effecting heat exchange, especially sensible heat exchange, in a plurality gas streams, for example, a cross flow heat exchanger or a rotary regenerative heat exchanger. More particularly, the present invention relates to a heat exchange element for use in this heat exchange apparatus and a process for the preparation of this heat exchange element.

(2) Description of the Related Art

Gas heat exchange elements formed by preparing a sheet from an organic fiber or inorganic fiber as the main starting material and processing the sheet to a honeycomb structure member are known, as disclosed in Japanese Patent Application Laid-Open Specifications No. 127663/77 and No. 19548/79. Heat exchange elements of this type are advantageous over heat exchange elements having a similar honeycomb structure, which are obtained by extrusion molding of ceramic materials, in that the weight is light, an element having a large size can be prepared and the productivity is high. Accordingly, heat exchange elements of this type have been practically used for cross flow heat exchangers and rotary regenerative heat exchangers or in other fields.

According to the intended use, gas heat exchanger elements are roughly divided into an element for exchange of sensible heat, an element of exchange of latent heat (dehumidification or reduction of the humidity) and an element for exchange of total heat (sensible heat and latent heat). In elements for exchange of latent heat and exchange of total heat, a moisture-absorbing agent such as lithium chloride, lithium bromide or a molecular sieve is supported on a sheet material.

In a gas heat exchange element formed by processing a sheet material (hereinafter referred to as "heat exchange element"), the properties required in addition to the heat exchange capacity are a durability under severe conditions, to which a sensible heat exchange element is exposed, and a gas-intercepting property.

More specifically, when the heat exchange element is used as a sensible heat exchange element, if a gas containing, for example, an oxide of sulfur is treated in a low-medium temperature region, the sulfur oxide is condensed and adheres to and permeates into the heat exchange element. Accordingly, the heat exchange element cannot be used for a long time because of early deterioration of physical properties unless the heat exchange element has not only a heat resistance but also an acid resistance.

Furthermore, it is desired that a sheet material constituting an element of a cross flow heat exchanger or rotary regenerative heat exchanger having a honeycomb-shaped fluid passage will not allow permeation of a gas and will have a good gas-intercepting property so that mingling of gases is not caused in the portion acting as a partition wall for two gases, between which heat exchange is effected.

In many cases, the required acid resistance can be attained if the sheet constituting the heat exchange element is wholly composed of a material having a good acid resistance. Furthermore, the gas-intercepting property can be improved by increasing the pack density or coated amount of an inorganic filler used for the sheet material. However, it is very difficult to simultaneously attain a high acid resistance and a high gas-intercepting property in a heat exchange element composed of a sheet material without degradation of light weight and thin thickness characteristics of the sheet material. Accordingly, even in conventional heat exchange elements having a relatively good gas-intercepting property, the level of this gas-intercepting property is still very low.

SUMMARY OF THE INVENTION

It is a primary object of the present invention to provide a heat exchange element for effecting heat exchange in gas streams differing in the temperature, which has a high acid resistance and a high gas-intercepting property in combination while retaining a sheet-like or paper-like shape having light weight and thin thickness characteristics and also provide a process for the preparation of this heat exchange element.

According to the present invention, this object can be attained by a heat exchange element composed of a sheet material comprising an acid-resistant glass fiber, an inorganic filler and a binder as main constituents, wherein at least 85% by weight of the entire element material is occupied by $SiO_2$ or $SiO_2$ and $ZrO_2$, at least a part of the inorganic filler has a scaly shape, the scaly inorganic filler is predominantly located in the vicinity of the surface of the sheet and the majority of particles of the scaly inorganic filler are arranged in parallel to the surface of the sheet to form a highly gas-intercepting region.

The acid resistance of a heat exchange element composed of a sheet material depends on the overall acid resistance of all the constituents of the sheet material. Therefore, the sheet material of the heat exchange element of the present invention is composed of highly acid-resistant glass fiber and inorganic filler as much as possible. As the highly acid-resistant glass fiber suitable for the production of the heat exchange element of the present invention, there can be mentioned a glass fiber containing 5 to 25% by weight of $ZrO_2$, a C glass fiber and a silica glass fiber. The zirconium oxide-containing glass fiber is commercially available as an alkali-resistant glass fiber, and as specific examples of the commercial product, there can be mentioned Alfiber (Asahi Glass) and CEM-FIL (Pilkinton). A preferred composition of this glass fiber is as described below (the parenthesized values indicate an especially preferred composition).

$SiO_2$: 50 to 70% by weight
$ZrO^2$: 5 to 25% by weight (15 to 25% by weight)
$Al_2O_3$: 0 to 10% by weight
RO*: 0 to 20% by weight
$R_2O$**: 10 to 25% by weight
Other components: 0 to 5% by weight Note
*: alkaline earth metal oxides and $MnO_2$
**: alkali metal oxides So far as stress is laid on the acid resistance of the heat exchange element, it is preferred that an inorganic filler having a high acid resistance, for example, silica powder or zirconia powder, be used as the inorganic filler for filling spaces among filaments of the glass fiber to increase the gas-intercepting property of the sheet material. However, no satisfactory gas-intercepting property can be attained by using such power alone. Accordingly, in the heat exchange element of the present invention, a scaly inorganic filler is used as at least a part of the inorganic filler, and this scaly filler is predominantly distributed in a portion as close to the surface of the sheet material as possible. Flat and scaly particles of the scaly inorganic filler distributed predominantly in the surface portion of the sheet material are inevitably arranged in parallel to the surface of the sheet material, and the surface of the sheet material is sufficiently covered with a small amount of the scaly inorganic filler to form a layer having a high gas-intercepting property.

The maximum particle size of the scaly inorganic filler that can be used for the heat exchange element of the present invention is smaller than about 40μ. It is difficult to stably support a scaly inorganic filler having too large a particle size on the sheet material. C glass flake can be mentioned as a preferred example. This flake has a good acid resistance, and therefore, the flake is preferably used for a heat exchange element for which an especially high acid resistance is required. However, the particle thickness is as large as about 3μ and it is difficult to use a sufficient amount of the flake having a sufficiently large diameter (stable supporting is impossible). Accordingly, if this flake alone is used as the inorganic filler, the attainable gas-intercepting property is not so high. On the other hand, mica powder has a particle thickness smaller than about 1μ and is very thin. Accordingly, even if mica powder having a sufficiently large diameter and a large covering power is used, the mica powder can be stably supported. Therefore, the mica powder is very effective for improving the gas-intercepting property. However, since the acid resistance of the mica powder is relatively poor, if the mica powder is used in a large amount, the acid resistance of the heat exchange element is degraded. In view of the foregoing, it is preferred that the mica powder be used in combination with an inorganic filler having a good acid resistance, for example, the above-mentioned C glass flake. At least 10% by weight of the entire sheet material may be occupied by the scaly inorganic filler or particles.

Irrespectively of the combination of the ingredients, the heat exchange element of the present invention is prepared so that at least 85%, preferably 85 ~ 93%, by weight of the entire sheet material is occupied by $SiO_2$ ($SiO_2$ and $ZrO_2$ in the case where a $ZrO_2$-containing material is used). This condition is indispensable for obtaining a high acid resistance required when the heat exchange element is used for exchange of sensible heat in sulfur oxide-containing gases.

According to the preparation process of the invention, the above-mentioned heat exchange element is prepared by forming a sheet made from an acid-resistance glass fiber and filled with an inorganic filler, dipping the sheet in a suspension of an inorganic filler, at least a part of which has a scaly shape, and fixing the inorganic filler attached by the dipping treatment to the surface of the sheet by a binder.

According to the present invention, not only a heat exchange element composed of one sheet material but also a so-called honeycomb structure heat exchange element formed by laminating a plurality of sheets having a wavy pattern, such as corrugated sheets to form many independent gas passages among the sheets is provided.

The heat exchange element of this type is used for a so-called cross flow heat changer where heat exchange is effected in a plurality of gases flowing orthogonally to each other or a so-called rotary regenerative heat exchanger which is arranged between two gas streams to accumulate the heat energy of a high-temperature gas and supply the accumulated heat energy to a low-temperature gas.

According to the present invention, the above-mentioned heat exchange element having a honeycomb structure is prepared by forming a plurality of sheets made from an acid-resistant glass fiber and filled with an inorganic filler, fabricating a honeycomb structure having a shape necessary for heat exchange by using these sheets, dipping the honeycomb structure in a suspension of an inorganic filler, at least a part of which has a scaly shape, and fixing the inorganic filler attached by the dipping treatment to the surfaces of the sheets by a binder.

For the production of a honeycomb structure from a plurality of sheets, there is adopted a process in which a plurality of sheets are processed to have an appropriate shape by corrugation or the like and laminating the sheets by an adhesive. The lamination treatment includes final drying and calcination.

The process for preparing a highly gas-intercepting heat exchange element according to the present invention will now be described in detail.

At first, a sheet is made from a glass fiber according to a customary paper-making method. The preferred thickness of the sheet is about 0.2 to about 1.5 mm. If the thickness is too large, subsequent processing becomes difficult. In order to improve the processability of the sheet, the formed sheet is subjected to a coating treatment.

As the coating material, there is used a mixture of an organic binder selected from a vinyl acetate resin, an ethylene/vinyl acetate copolymer, polyethylene, a water-soluble acrylic resin, a water-soluble urethane resin, a vinyl chloride resin, a vinylidene chloride resin, a polyvinyl alcohol resin, starch, oxidized starch and casein and an acid-resistant inorganic filler having a particle size smaller than 20μ, preferably about 0.5 to about 10μ.

A scaly filler having a large particle size is accumulated in the surface portion of the sheet but is not filled to the interior core portion, and furthermore, this scaly filler renders it difficult to fill a filler which can inherently be easily filled. Accordingly, in case of a heat exchange element other than a heat exchange element composed solely of one sheet, that is, in case of a honeycomb heat exchange element formed by laminating a plurality of sheets, use of this scaly filler at the lamination stage is not preferred. The amount applied of the coating material is adjusted to a level sufficient to give the sheet a processability necessary for the subsequent processing operation (ordinarily, 200 to 500 g/m$^2$), and application of the coating material in excess is not preferred.

The coated sheet is dried and is then subjected to a processing operation necessary for formation of a honeycomb structure, for example, a corrugating treatment. Then, the processed sheet is laminated with another processed sheet or an unprocessed sheet so that a heat exchange element having a desired shape will be obtained. An organic adhesive is not suitable for the lamination treatment. An inorganic adhesive capable of providing a bonding sufficiently resistant to a calcination treatment described below and also providing a cured product having a good acid resistance is used. As preferred examples of the adhesive, there can be mentioned an adhesive formed by mixing a component selected from alumina sol, colloidal silica and an alkali metal silicate (such as sodium silicate) with a filler selected from amorphous silica, quartzite and C glass flake, and an adhesive formed by adding a thickening agent selected from methyl cellulose and carboxymethyl cellulose to the above-mentioned adhesive for adjusting viscosity, water-retaining property, initial adhesiveness and shrinkage-preventing property.

A scaly inorganic filler or its mixture with other inorganic filler is applied and fixed to a plurality of the sheets formed into a honeycomb structure by the above-mentioned processing and lamination treatments. This step is accomplished by dipping the honeycomb structure in an aqueous dispersion of an acid-resistant binder such as colloidal silica and the inorganic filler, draining the honeycomb structure and finally, drying and calcining the honeycomb structure.

By the calcination, the binder is cured and the inorganic filler is fixed, and simultaneously, the organic component is removed from the honeycomb structure. If necessary, the honeycomb structure is further subjected to the above-mentioned dipping treatment and heat-drying treatment again (a desired number of times). By repeating the above treatments, the gas-intercepting property of the product is improved. Furthermore, if the honeycomb structure is finally subjected to the dipping treatment with the binder alone, the strength is increased. Ethyl silicate is preferred as the binder because it is excellent in the permeability and even if a filler which is relatively poor in the acid resistance, such as silica powder, is used, since mica is covered with the binder, a product having a high acid resistance can be obtained. The surface of the honeycomb structure can be coated with a fluorine resin (for example, a tetrafluoroethylene/hexafluoropropylene copolymer resin) so as to prevent adhesion of dust.

The starting materials and treating materials to be used at all of the above-mentioned steps should be selected so that at least 85% by weight of the finally obtained heat exchange element should be occupied by $SiO_2$ or $SiO_2$ and $ZrO_2$. Thus, a heat exchange element having a high acid resistance can be obtained. On the other hand, a high gas-intercepting property is attained by the action of the scaly inorganic filler. Accordingly, even if the heat exchange element of the present invention is used for exchange of sensible heat in gases containing an oxide of sulfur, it can be used for a long time. Moreover, contamination of a clean gas by mingling of other gas is prevented.

Needless to say, the obtained heat exchange element can be used directly or after such processing as cutting, perforation or bonding for imparting a size, shape or structure required for a heat exchange element.

The present invention is not limited to the above-mentioned honeycomb heat exchange element and the process for the preparation, but it includes a hand-made sheet-like heat exchange element and a processed sheet-like heat exchange element. A plane sheet-like heat exchange element can be prepared according to the above-mentioned process for the production of the honeycomb heat exchange element, from which the sheet-processing and laminating treatments are removed, and a processed sheet-like heat exchange element can be prepared according to the above-mentioned process for the production of the honeycomb heat exchange element, from which the laminating treatment is removed.

The present invention will now be described in detail with reference to the following examples, but the scope of the invention is not limited by the examples and the present invention includes changes and modifications without departing from the scope of the invention.

DETAILED DESCRIPTION OF THE PREFERRED EMBODIMENTS,

EXAMPLES 1 through 5 and COMPARATIVE EXAMPLES 1 through 4

Figure 1:
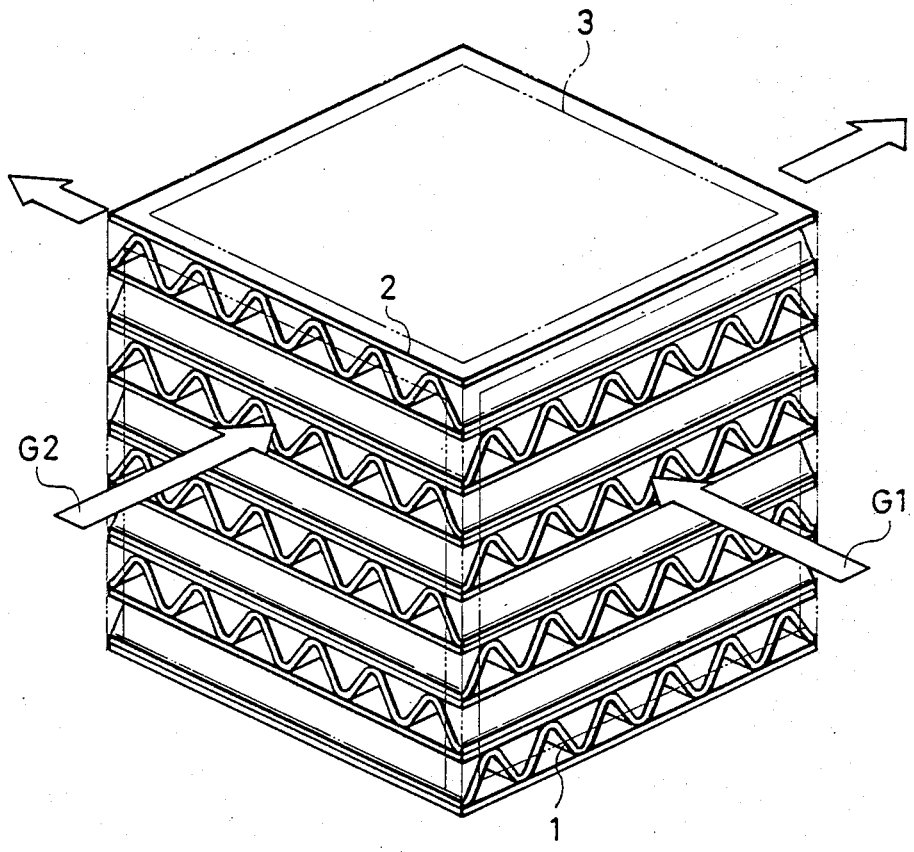
FIG. 1 is a perspective view illustrating an embodiment in which a heat exchange element having a honeycomb structure according to the present invention is applied to a cross flow heat exchanger.

A sheet having a thickness of 1 mm and a base weight of 120 g/m$^2$ was made from a zirconium oxide-containing glass fiber (average fiber length=9 mm) comprising 17% by weight of $ZrO_2$, 62% by weight of $Si0_2$, 0.5% by weight of $Na_2O/K_2O$ and 16% by weight of CaO, and the sheet was coated with a silica powder dispersion containing polyvinyl alcohol as the binder in an amount of 300 g/m$^2$ as silica. A part of the coated sheet was corrugated by a corrugating machine for preparing corrugated boards and was piled on and bonded to the unprocessed plane sheet, and lamination was further conducted so that the corrugating directions orthogonally cross each other to form a four-layer honeycomb structure as shown in FIG. 1 (plane shape of 45 mm×45 mm, thickness in lamination direction of 32 mm, flute height of 8 mm). In FIG. 1, reference numeral 1 represents a corrugated sheet and reference numeral 2 represents an uncorrugated sheet.

The honeycomb structure was dipped in a treating liquid A(containing silica powder, C glass flake, mica powder and colloidal silica as the binder), and the honeycomb structure was drained and calcined at 400° C. to remove the organic substances. Then, the honeycomb structure was dipped in the treating liquid A again and dried, and finally, the honeycomb structure was dipped in a treating liquid B (ethyl silicate solution), subjected to a steam treatment to form silica from ethyl silicate and dried (Examples 1, 2 and 5).

A heat exchange element composed of one sheet was prepared in the same manner as described above except that the corrugating and laminating treatments were omitted.

In Example 3, the procedures of Example 1 were repeated in the same manner except that the treatment with the treating liquid B was omitted, and in Example 4, the procedures of Example 1 were repeated in the same manner and a fluorine resin was then coated in an amount of 10% by weight.

Furthermore, in Comparative Example 2, the procedures of Example 1 were repeated in the same manner except that the treating liquid A was changed to a treating liquid containing only colloidal silica, and in Comparative Example 3, the procedures of Example 1 were repeated in the same manner except that a treating liquid containing only silica and colloidal silica was used as the treating liquid A. In Comparative Example 3, the procedures of Example 1 were repeated in the same manner except that a treating liquid containing kaolin and colloidal silica was used instead of the treating liquid A. In Comparative Example 1, the procedures of Example 1 were repeated in the same manner except that a sheet of E glass fiber inferior in the acid resistance was used. Incidentally, kaolin was also used for coating of the sheet in Comparative Example 4.

Each of the heat exchange elements prepared in these examples was arranged in streams of high-temperature gas G1 and low-temperature gas G2 orthogonally crossing each other and its ridge lines were supported and fixed by a supporting frame structure 3, as shown in FIG. 1, and each heat exchange element was practically used as the so-constructed cross flow heat exchanger, and heat exchange was effected between both the gases G1 and G2.

Incidentally, in the corrugated sheet on the side of the high-temperature gas, the corrugating width (wave height) can be made larger than in the corrugated sheet on the side of the low-temperature gas.

With respect to each of the so-obtained heat exchange elements, the material construction and characteristic properties are collectively shown in Table 1. Incidentally, the compression strength, acid resistance and air permeability were determined according to the following methods.

Compression strength:

The sample was compressed at a speed of 5 mm/min in a direction vertical to one flute open plane and the compression strength was measured by a universal testing machine.

Acid resistance:

The sample was immersed in 50% sulfuric acid at 120 ° C. for 7 days, and the sample was washed with water and dried. Before and after this treatment, the weight and compression strength were measured, and the decrease (%) of the weight and the reduction (%) of the compression strength were determined as criterions for evaluating the acid resistance.

Air permeability:

With respect to a plane sheet prepared separately from the honeycomb structure under the same conditions, the air permeability was measured under a pressure difference of 100 mmAg by using air as the gas.

TABLE 1

| Remarks | Example 1 | Example 2 | Example 3 not treated with treating liquid B | Example 4 treated with fluorine resin | Example 5 amount of glass flake was increased | Comparative Example 1 E glass fiber was used | Comparative Example 2 filler was not contained in treating liquid A | Comparative Example 3 scaly powder was not added | Comparative Example 4 amount of ($SiO_2$ + $ZrO_2$) was smaller than 85% |
|---|---|---|---|---|---|---|---|---|---|
| Composition (%) of ingedients in Product | | | | | | | | | |
| fiber | 10 | 10 | 11 | 10 | 9 | 10 | 13 | 10 | 10 |
| filler(derived from sheet) | 25 | 25 | 28 | 25 | 23 | 28 | 33 | 25 | kaolin 25 |
| filler(derived from treating liquid A | | | | | | | | | kaolin 25 |
| silica | 12.5 | 2.5 | 13.8 | 12.5 | 12.5 | 12.5 | 10 | 25 | |
| glass flake | 7.5 | 7.5 | 8.5 | 7.5 | 15 | 7.5 | | | |
| mica powder | 5.0 | 15.0 | 5.7 | 5.0 | 5.0 | 5.0 | | | |
| binder(derived from | 30 | 30 | 33 | 30 | 25.5 | 30 | 40 | 30 | 30 |
| binder(derived from treating liquid B) | 10 | 10 | | 10 | 10 | 10 | 14 | 10 | 10 |
| characteristic properties of product | | | | | | | | | |
| $SiO_2$ + $ZrO_2$ | 90.9 + 1.7 | 85.4 + 1.7 | 89.9 + 1.9 | 90.9 + 1.7 | 88.7 + 1.5 | 90.1 + 1.7 | 95.1 + 2.2 | 96.2 + 1.7 | 69.7 + 1.7 |
| density(kg/m$^3$) | 400 | 390 | 360 | 440 | 405 | 400 | 320 | 380 | 390 |
| compression strength (kg/cm$^2$) | 100 | 90 | 75 | 110 | 105 | 100 | 45 | 75 | 85 |
| acid resistance | | | | | | | | | |
| weight decrease(%) | 4.0 | 11.0 | 3.8 | 2.0 | 4.3 | 5.5 | 0.5 | 2.0 | 20.0 |
| strength reduction(%) | 10.0 | 15.0 | 13.0 | 4.5 | 9.5 | 70.0 | 12.5 | 6.7 | 70.6 |
| air permeability* | 3 | 1 | 4 | 0 | 1 | 3 | 500 | 200 | 45 |

*ml/min · 100 cm$^2$ · 100 mmAq

Figure 2:
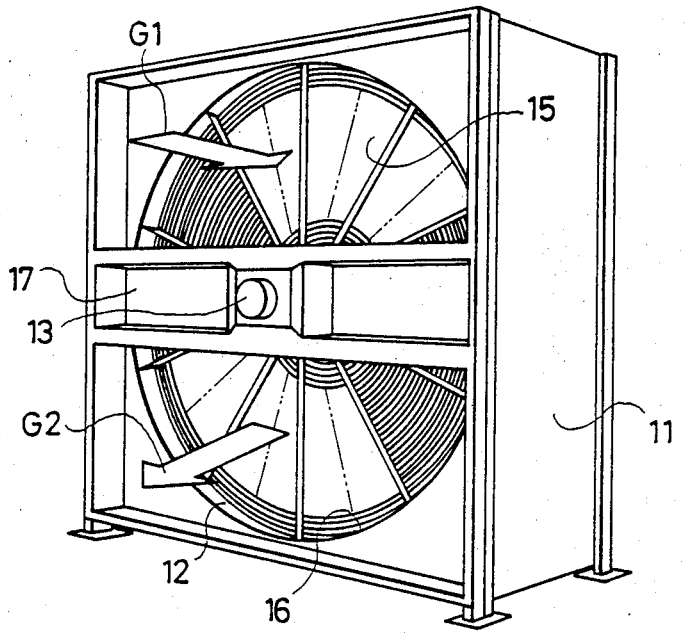
FIG. 2 is a perspective view illustrating an embodiment in which a heat exchange element having a honeycomb structure according to the present invention is applied to a rotary regenerative heat exchanger.
Figure 3:
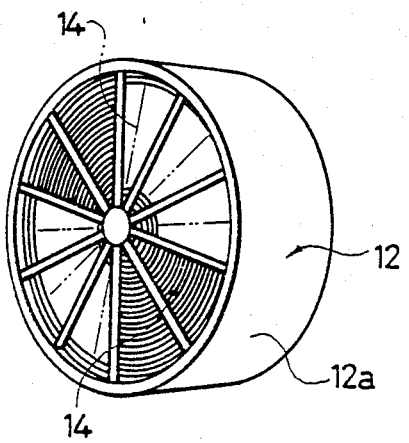
FIG. 3 is a perspective view illustrating a rotary regenerative member of the rotary regenerative heat exchanger shown in FIG. 2.
Figure 4:
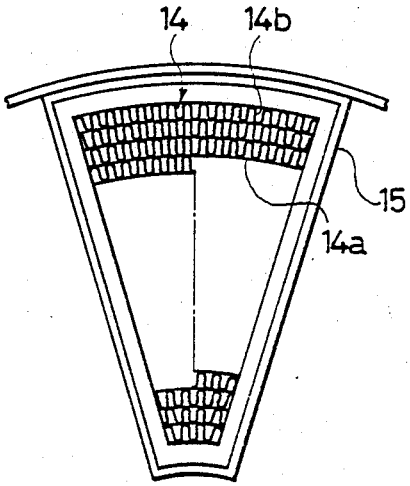
FIG. 4 is a front view showing one segment of the rotary regenerative member shown in FIG. 3.

A rotary regenerative heat exchanger as shown in FIG. 2 can be assembled by using the sheet material of the present invention. In a stand-type frame casing 11 shown in FIG. 2, a rotor casing 12 is rotatably supported on a driving shaft 13. The rotor casing 12 is constructed by arranging and fixing a heat exchange element 14 of the present invention having a substantially fan-shaped form in a segment case 15 having a substantially fan-shaped form, gathering such elements and segment cases in the form of a column around the driving shaft 13 and arranging and fixing the assembly within a cylindrical outer wall 12*a*. The segment case 15 and the heat exchange element 12 are fixed through a sheet material. As shown in FIG. 4, the heat exchange element 14 comprises many arc-shaped sheets 14*a* forming parts of concentric circles and equidistantly spaced in the radial direction and corrugated sheets 14*b* laminated alternately with the sheets 14*a*. Gas passages of a honeycomb structure penetrating in the direction of the driving shaft 13 are defined by the uncorrugated sheets 14*a* and the corrugated sheets 14*b*. This heat exchange element 14 can be prepared according to the same process as the above-mentioned process for the production of the heat exchange element for the cross flow heat exchanger except that the corrugated sheets 14*b* are laminated in the same direction. Therefore, the detailed explanation is omitted. A gas passage opening 16 is formed on the front surface of the frame casing 11, and a partition plate 17 extending in the groove direction is arranged on the opening 16 to supply two gas streams to the heat exchange element 14. Namely, a high-temperature gas passage G1 and a low-temperature gas passage G2 are formed.

The heat exchange element 14 is rotated, and when the heat exchange element 14 is located at the high-temperature gas passage G1, the heat exchange element 14 is heated to accumulate heat. When the heat exchange element 14 is further rotated and located at the low-temperature gas passage G2, the accumulated heat is radiated to heat the low-temperature gas.

We claim:

1. A heat exchange element arranged in a plurality of gases to effect heat exchange in said gases, which is composed of a sheet material comprising an acid-resistant glass fiber, an inorganic filler and a binder as main constituents, wherein at least 85% by weight of the entire sheet material is occupied by $SiO_2$ or $SiO_2$ and $ZrO_2$, the inorganic filler comprises at least scaly particles which is predominantly located in the vicinity of the surface of the sheet material and the majority of which is arranged in parallel to the surface of the sheet material to form a highly gas-intercepting region in the sheet material.

2. A heat exchange element as set forth in claim 1, wherein the scaly particles of the inorganic filler are of C glass flake or a mixture of C glass flake and mica powder.

3. A heat exchange element as set forth in claim 1, wherein the scaly particles of the inorganic filler have a maximum particle size smaller than about 40μ.

4. A heat exchange element as set forth in claim 1, wherein the inorganic filler comprises scaly particles and non-scaly particles and the non-scaly particles are composed of silica powder or zirconia powder.

5. A heat exchange element for effecting heat exchange in a plurality of gases, which has a honeycomb structure composed of a sheet material comprising an acid-resistant glass fiber, an inorganic filler and a binder as main constituents, wherein at least 85% by weight of the entire sheet material is occupied by $SiO_2$ or $SiO_2$ and $ZrO_2$, the inorganic filler comprises at least scaly particles which is predominantly located in the vicinity of the surface of the sheet material and the majority of which is arranged in parallel to the surface of the sheet material to form a highly gas-intercepting region in the honeycomb structure.

6. A heat exchange element as set forth in claim 5, wherein the scaly particles of the inorganic filler are of C glass flake or a mixture of C glass flake and mica powder.

7. A heat exchange element as set forth in claim 5, wherein the inorganic filler comprises scaly particles and non-scaly particles and the non-scaly particles are composed of silica powder or zirconia powder.

8. A heat exchange element as set forth in claim 5, wherein the sheet material comprises a sheet made from a glass fiber, a coating formed on the surface of the fiber sheet, said coating being composed of a mixture of an organic binder selected from the group consisting of a vinyl acetate resin, an ethylene/vinyl acetate copolymer, polyethylene, a water-soluble acrylic resin, a water-soluble polyurethane resin, a vinyl chloride resin, a vinylidene chloride resin, a polyvinyl alcohol resin, starch, oxidized starch and casein and an acid-resistant inorganic filler having a particle size smaller than 20μ, and a layer composed of a scaly inorganic filler or a mixture of a scaly inorganic filler and a non-scaly inorganic filler, which is formed on the coating.

9. A heat exchange element as set forth in claim 7, wherein the sheet material further comprises a fluorine resin coating layer formed on the surface thereof.

10. A heat exchange element as set forth in claim 5, wherein the honeycomb structure is constructed by laminating a plurality of unprocessed and/or processed sheets and bonding them to one another.

11. A heat exchange element as set forth in claim 5, wherein the binder is ethyl silicate.

12. A heat exchange element as set forth in claim 5, wherein the honeycomb structure is constructed by alternately laminating and fixing flat sheets and corrugated sheets, and the corrugated sheets are arranged so that the corrugating directions of the corrugated sheets are orthogonal to one another.

13. A heat exchange element as set forth in claim 5, wherein the honeycomb structure is constructed by alternately laminating and fixing arcuate sheets and corrugated sheets, and the corrugated sheets are arranged so that the corrugating directions of the corrugated sheets are the same.

14. A heat exchange apparatus comprising a honeycomb structure housed in a casing through which two gas streams flow, said honeycomb structure being composed of a sheet material comprising an acid-resistant glass fiber, an inorganic filler and a binder as main constituents, wherein at least 85% by weight of the entire sheet material is occupied by $SiO_2$ or $SiO_2$ and $ZrO_2$, the inorganic filler comprises at least scaly particles which is predominantly located in the vicinity of the surface of the sheet material and the majority of which is arranged in parallel to the surface of the sheet material to form a highly gas-intercepting region in the honeycomb structure.

15. A heat exchange apparatus as set forth in claim 14, wherein the honeycomb structure is a cross flow heat exchange element having a honeycomb gas passage through which two gas streams crossing each other orthogonally flow.

16. A heat exchange apparatus as set forth in claim 14, wherein the honeycomb structure is a rotary regenerative heat exchange element having a honeycomb-shaped gas passage through which two parallel streams flow, and the honeycomb structure is housed in a rotatable rotor arranged in said two gas streams.

* * * * *